US007808764B2

(12) United States Patent
O'Brien et al.

(10) Patent No.: US 7,808,764 B2
(45) Date of Patent: Oct. 5, 2010

(54) SYSTEM AND METHOD FOR AVOIDING CONTACT STICTION IN MICRO-ELECTROMECHANICAL SYSTEM BASED SWITCH

(75) Inventors: Kathleen Ann O'Brien, Albany, NY (US); Kanakasabapathi Subramanian, Clifton Park, NY (US); Nicole Christine Reeves Hedges, Albany, NY (US); Michael Solomon Idelchik, Niskayuna, NY (US); Owen Jannis Schelenz, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 517 days.

(21) Appl. No.: 11/931,353

(22) Filed: Oct. 31, 2007

(65) Prior Publication Data

US 2009/0107813 A1 Apr. 30, 2009

(51) Int. Cl.
*H01H 47/00* (2006.01)

(52) U.S. Cl. ..... 361/166

(58) Field of Classification Search ..... 361/166
See application file for complete search history.

(56) References Cited

U.S. PATENT DOCUMENTS

| | | | | |
|---|---|---|---|---|
| 3,496,409 | A | 2/1970 | Connell | |
| 3,809,959 | A | 5/1974 | Pucher | |
| 4,500,934 | A | 2/1985 | Kinsinger | |
| 4,700,256 | A | 10/1987 | Howell | |
| 4,723,187 | A | 2/1988 | Howell | |
| 5,164,872 | A | 11/1992 | Howell | |
| 5,374,792 | A | 12/1994 | Ghezzo et al. | |
| 5,430,597 | A | 7/1995 | Bagepalli et al. | |
| 5,822,170 | A | 10/1998 | Cabuz et al. | |
| 6,563,683 | B1 | 5/2003 | Strumpler | |
| 6,738,246 | B1 | 5/2004 | Strumpler | |
| 6,760,202 | B1 | 7/2004 | Meyer et al. | |
| 6,836,029 | B2 * | 12/2004 | Greenberg et al. | 307/139 |
| 6,919,784 | B2 | 7/2005 | Feng et al. | |
| 6,931,173 | B1 | 8/2005 | Wang et al. | |
| 7,190,092 | B2 * | 3/2007 | Ivanciw et al. | 307/134 |
| 2003/0183838 | A1 | 10/2003 | Huang et al. | |
| 2005/0146404 | A1 | 7/2005 | Yeatman | |
| 2005/0146814 | A1 | 7/2005 | Sellier et al. | |

(Continued)

FOREIGN PATENT DOCUMENTS

| | | | |
|---|---|---|---|
| WO | WO0039915 | A1 | 7/2000 |

OTHER PUBLICATIONS

European Search Report dated Feb. 27, 2009.

*Primary Examiner*—Stephen W Jackson
(74) *Attorney, Agent, or Firm*—Richard D. Emery

(57) ABSTRACT

A system that includes micro-electromechanical system switching circuitry, such as may be made up of a plurality of micro-electromechanical switches, is provided. The plurality of micro-electromechanical switches may generally operate in a closed switching condition during system operation. A controller is coupled to the electromechanical switching circuitry. The controller may be configured to actuate at least one of the micro-electromechanical switches to a temporary open switching condition while a remainder of micro-electromechanical switches remains in the closed switching condition to conduct a load current and avoid interrupting system operation. The temporary open switching condition of the switch is useful to avoid a tendency of switch contacts to stick to one another.

21 Claims, 4 Drawing Sheets

U.S. PATENT DOCUMENTS

2006/0187688 A1 8/2006 Tsuruya
2006/0202933 A1 9/2006 Pasch et al.
2007/0139829 A1 6/2007 Arthur
2007/0139830 A1 6/2007 Premerlani

* cited by examiner

SYSTEM AND METHOD FOR AVOIDING CONTACT STICTION IN MICRO-ELECTROMECHANICAL SYSTEM BASED SWITCH

BACKGROUND OF THE INVENTION

Embodiments of the invention relate generally to electrical circuitry, and, more particularly, to micro-electromechanical system (MEMS) based switching devices, and, even more particularly, to a system and method for avoiding a tendency of switch contacts to stick to one another without interrupting system operation.

A circuit breaker is an electrical device designed to protect electrical equipment from damage caused by faults in the circuit. Traditionally, most conventional circuit breakers include bulky electromechanical switches. Unfortunately, these conventional circuit breakers are large in size thereby necessitating use of a large force to activate the switching mechanism. Additionally, the switches of these circuit breakers generally operate at relatively slow speeds. Furthermore, these circuit breakers are disadvantageously complex to build and thus expensive to fabricate. In addition, when contacts of the switching mechanism in conventional circuit breakers are physically separated, an arc is typically formed there between which continues to carry current until the current in the circuit ceases. Moreover, energy associated with the arc may seriously damage the contacts and/or present a burn hazard to personnel.

As an alternative to slow electromechanical switches, it is known to use relatively fast solid-state switches in high speed switching applications. As will be appreciated, these solid-state switches switch between a conducting state and a non-conducting state through controlled application of a voltage or bias. For example, by reverse biasing a solid-state switch, the switch may be transitioned into a non-conducting state. However, since solid-state switches do not create a physical gap between contacts when they are switched into a non-conducting state, they experience leakage current. Furthermore, due to internal resistances, when solid-state switches operate in a conducting state, they experience a voltage drop. Both the voltage drop and leakage current contribute to the dissipation of excess power under normal operating circumstances, which may be detrimental to switch performance and life.

MEMS switching devices can offer notable advantages over traditional electromechanical switches and solid-state switches. It has been observed, however, that MEMS switching devices can exhibit contact stiction or a tendency of contacts of the switch to stick to one another (e.g., the switch contacts can remain closed when commanded to open, or can exhibit an unacceptable time delay in opening when commanded to open) after having been closed for a relatively long period of time, which may vary depending on the characteristics of a given switch.

It is known that contact stiction can occur, for example, due to metal diffusion over time of contact materials. This stiction phenomenon is likely to occur in operational situations when the switches are used in applications—such as circuit breaker applications—where the normal operating state of the switch is closed. This can lead to degraded performance when the switching device takes longer to open than a specified switching time, and can even lead to a failure when the switch fails to open at all. Accordingly, it is desirable to provide a system and/or control techniques for reducing or avoiding this tendency to stick of MEMS switching devices and thus incrementally contribute to the overall reliability of the system and/or application in which the switch is used.

BRIEF DESCRIPTION OF THE INVENTION

Generally, aspects of the present invention provide a system that includes micro-electromechanical system switching circuitry, such as may be made up of a plurality of micro-electromechanical switches. The plurality of micro-electromechanical switches may generally operate in a closed switching condition during system operation. A controller is coupled to the electromechanical switching circuitry. The controller may be configured to actuate at least one of the micro-electromechanical switches to a temporary open switching condition while a remainder of micro-electromechanical switches remains in the closed switching condition to conduct a load current and avoid interrupting system operation. The temporary open switching condition of the switch is useful to avoid a tendency of switch contacts to stick to one another.

Further aspects of the present invention provide a system including a micro-electromechanical system switching circuitry such as may be made up of at least one micro-electromechanical switch that generally operates in a closed switching condition during system operation. A controller is coupled to the electromechanical switching circuitry to actuate the micro-electromechanical switch to a temporary open switching condition. An over-current protection circuitry may be connected in a parallel circuit with the micro-electromechanical system switching circuitry. The over-current protection circuitry may be configured to momentarily form an electrically conductive path during the temporary open switching condition. The electrically conductive path forms a parallel circuit with the micro-electromechanical system switching circuitry and is adapted to avoid current flow through contacts of the switch as the switch transitions to enter the temporary open switching condition from the closed switching condition. The path is further adapted to collapse a voltage level across the contacts of the switch as the switch returns out of the temporary open switching condition to the closed switching condition.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

In accordance with one or more embodiments of the present invention, a system including micro-electromechanical system (MEMS) switching circuitry will be described herein. In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply neither that these operations need to be performed in the order they are presented, nor that they are even order dependent. Moreover, repeated usage of the phrase "in one embodiment" does not necessarily refer to the same embodiment, although it may. Lastly, the terms "comprising", "including", "having", and the like, as used in the present application, are intended to be synonymous unless otherwise indicated.

Figure 1:
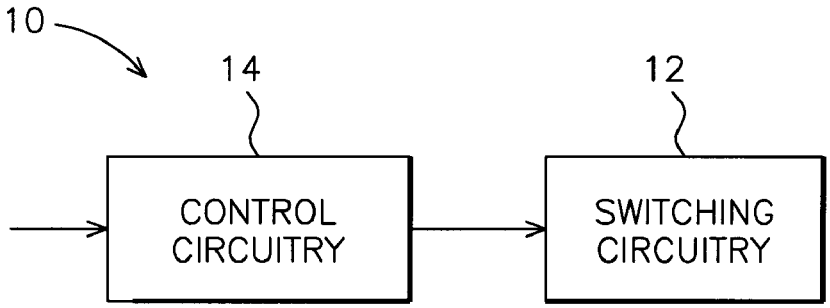
FIG. 1 is a block diagram of an exemplary MEMS based switching system, in accordance with aspects of the present technique.

FIG. 1 illustrates a block diagram of an example embodiment of a micro-electromechanical system (MEMS)-based switching system 10, in accordance with aspects of the present invention. Presently, MEMS generally refer to micron-scale structures that for example can integrate a multiplicity of functionally distinct elements, e.g., mechanical elements, electromechanical elements, sensors, actuators, and electronics, on one or more substrates through microfabrication technology. It is contemplated, however, that many techniques and structures presently available in MEMS devices will in just a few years be available via nanotechnology-based devices, e.g., structures that may be smaller than 100 nanometers in size. Accordingly, even though example embodiments described throughout this document may refer to MEMS-based switching system, it is submitted that the inventive aspects of the present invention should be broadly construed and should not be limited to micron-sized devices.

As illustrated in FIG. 1, MEMS based switching system 10 includes MEMS based switching circuitry 12. For example, in a circuit breaker application MEMS based switching circuitry 12 may be made up of a plurality of micro-electromechanical switches that generally operates in a closed switching condition to conduct a load circuit current during system operation. Accordingly, such switches may be vulnerable to contact stiction. As further illustrated in FIG. 1, a controller 14 is coupled to MEMS based switching circuitry 12.

Figure 2:
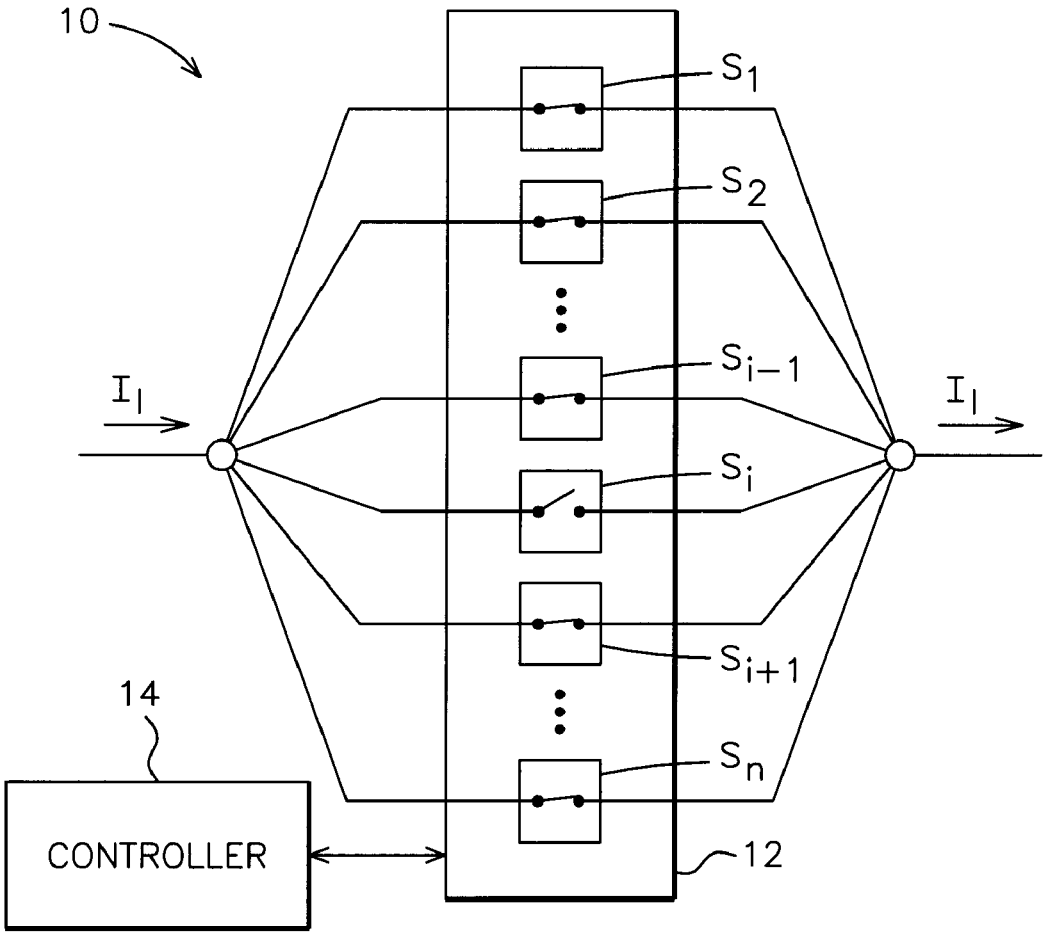
FIG. 2 illustrates example circuit details in connection with the MEMS based switching system of FIG. 1.

As shown in FIG. 2, controller 14 may be configured to actuate at least one of the micro-electromechanical switches (e.g., switch $S_i$) to a temporary open switching condition while a remainder of micro-electromechanical switches, such as switches $S_1$, $S_2$ through $S_{i-1}$ and $S_{i+1}$, through $S_n$ remain in the closed switching condition to conduct load circuit current ($I_1$) and avoid interrupting system operation. The inventors of the present invention have recognized that such temporary open switching condition of the switch (e.g., in the order of microseconds) is useful to avoid a tendency of switch contacts to stick to one another. It will be appreciated that the number of switches that may be simultaneously set to the temporary open switching condition need not be constrained to one switch. In one example embodiment this number may be based on the capability of the switches that remain closed to carry the incremental level of load circuit current due to the number of switches set to the temporary open condition. That is, the switches that remain closed would carry the load current they normally carry plus the alluded to incremental level of current due to the number of switches set to the temporary open condition. In the illustrated example, switches $S_1$, $S_2$ through $S_{i-1}$ and $S_{i+1}$ through $S_n$ in combination should be capable of carrying (in addition to the load current they normally carry) the incremental level of load circuit current due to switch $S_i$ being set to the temporary open condition. It will be appreciated that aspects of the present invention are not limited to parallel circuit arrangements of micro-electromechanical switches since series circuit arrangements or a combination of parallel and series circuit micro-electromechanical switches may equally benefit from aspects of the present invention.

In one example embodiment, controller 14 may be configured to perform a switching algorithm to actuate at least one distinct micro-electromechanical switch of the plurality of micro-electromechanical switches to the temporary open switching condition. Typically, this switch would be a switch not previously having been actuated over a predefined period of time (e.g., in the order of weeks, days, etc.) to the temporary open switching condition. Returning to the illustrated example, if switch $S_{i-}$ has already been set to the temporary open condition over the predefined period of time, then any switch (or switches not yet actuated) should then be set to the temporary open condition. While actuation of such at least one distinct micro-electromechanical switch to the temporary open switching condition occurs, another remainder of the micro-electromechanical switches would remain in the closed switching condition to avoid interrupting system operation. For example, if switches $S_1$ and $S_2$ are the switches presently set to the temporary open switching condition, then the remainder of micro-electromechanical switches in the closed switching condition would be switches $S_3$ (not shown) through $S_n$.

In one example embodiment, controller 14 is configured to selectively execute the switching algorithm over the predefined period of time so that eventually each of the plurality of switches is actuated at least once to the temporary open switching condition over such period of time. The switching algorith would ensure each switch of the micro-electromechanical system switching circuitry has been actuated to avoid the tendency of respective switch contacts to stick to one another.

Figure 3:
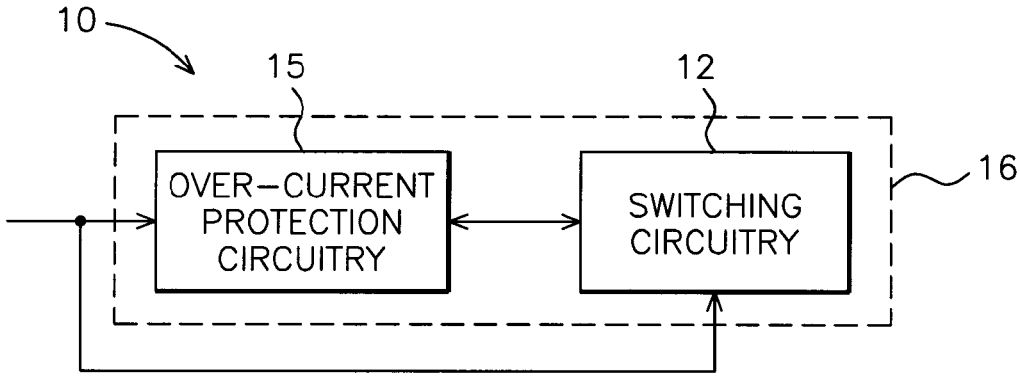
FIG. 3 is a block diagram of an exemplary MEMS based switching system, as may include an over current protection circuit.

In one example embodiment as illustrated in FIG. 3, circuitry such as over current protection circuitry 15 may be coupled to the micro-electromechanical system switching circuitry. The over current protection circuitry 15 may include a balanced diode bridge and a pulse circuit. Further, the over current protection circuitry 15 may be configured to facilitate suppression of an arc formation between contacts of the MEMS switches. It may be noted that the over current protection circuitry 15 may be configured to facilitate suppression of an arc formation in response to an alternating current (AC) or a direct current (DC).

For readers desirous of background information in connection with suppression of arc formation reference is made to U.S. patent application Ser. No. 11/314,336 filed on Dec. 20, 2005, which is incorporated by reference in its entirety herein. The foregoing application describes high-speed micro-electromechanical system (MEMS) based switching devices including circuitry and pulsing techniques adapted to suppress arc formation between contacts of the micro-electromechanical system. In such an application, arc formation suppression is accomplished by effectively shunting a current flowing through such contacts.

In accordance with further aspects of the present invention, over current protection circuitry 15 may be configured to avoid current flow through the contacts of each of the micro-electromechanical switches being actuated to the temporary open condition. For example, current flow is diverted (e.g., shunted) as each such switch transitions to enter the temporary open switching condition from the closed switching condition. Furthermore, over current protection circuitry 15 may be configured to collapse a voltage level across the contacts of each of the micro-electromechanical switches being actuated to the temporary open condition. For example, the voltage level would cause such a collapse as each such switch returns out of the temporary open switching condition to the closed switching condition.

In certain embodiments, the MEMS based switching circuitry 12 may be integrated in its entirety with the over current protection circuitry 15 in a single package 16, for example. In other embodiments, only certain portions or components of the MEMS based switching circuitry 12 may be integrated with the over current protection circuitry 15.

Generally, MEMS-based switching circuitry should not be closed to a conductive switching state in the presence of a voltage across its switching contacts nor should such circuitry be opened into a non-conductive switching state while passing current through such contacts. One example of a MEMS-compatible switching technique that avoids the foregoing issues may be a pulse-forming technique as described in the foregoing patent application.

Another example of a MEMS-compatible switching technique may be achieved by configuring the switching system to perform soft or point-on-wave switching whereby one or more MEMS switches in the switching circuitry 12 may be closed at a time when the voltage across the switching circuitry 12 is at or very close to zero, and opened at a time when the current through the switching circuitry 12 is at or close to zero. For readers desirous of background information regarding such a technique reference is made to patent application titled "Micro-Electromechanical System Based Soft Switching", U.S. patent application Ser. No. 11/314,879 filed Dec. 20, 2005.

Figure 5:
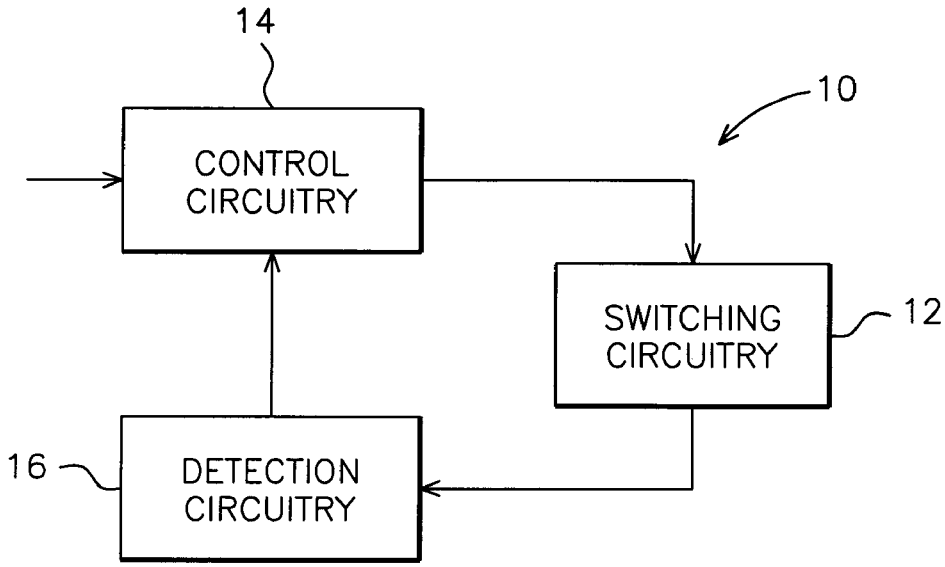
FIG. 5 is a block diagram of an exemplary MEMS based switching system, as may include zero crossings detection circuitry.

By closing one or more switches at a time when the voltage across the switching circuitry 12 is at or very close to zero, pre-strike arcing can be avoided by keeping the electric field low between the contacts of the one or more MEMS switches as such switches are commanded to a temporary open condition. As alluded to above and illustrated in FIG. 5, controller 14 may be configured to synchronize the opening and closing of the one or more MEMS switches of the switching circuitry 12 with the occurrence of a zero crossing of an alternating source voltage or an alternating load circuit current, as may be detected with a suitable zero-crossing detection circuitry 16.

Figure 4:
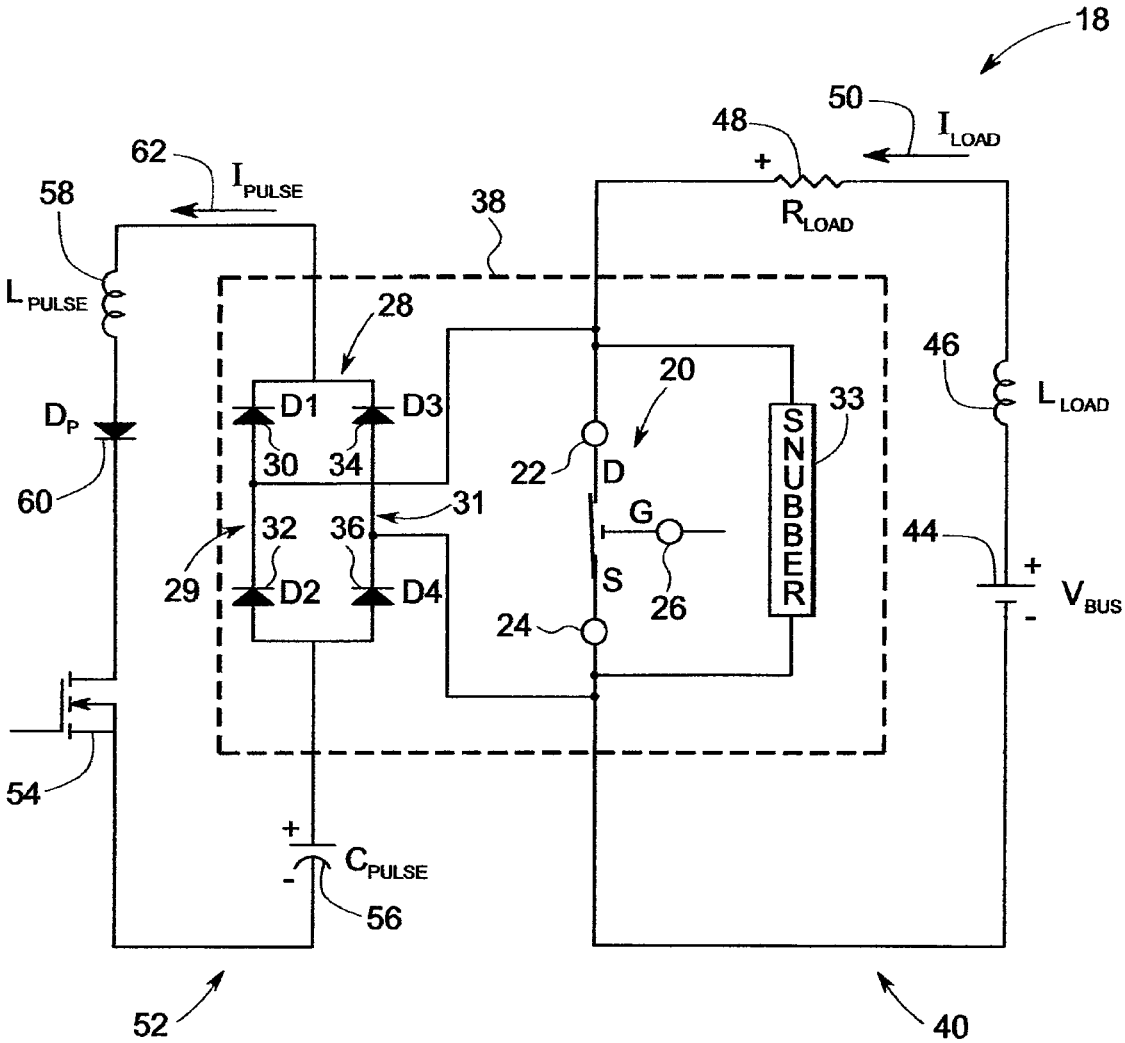
FIG. 4 is schematic diagram illustrating circuit details in connection with the MEMS based switching system of FIG. 3.

Turning now to FIG. 4, a schematic diagram 18 of the exemplary MEMS based switching system depicted in FIG. 3 is illustrated in accordance with one example embodiment of over current protection circuitry. In the illustrated embodiment, a first MEMS switch 20 is depicted as having a first contact 22, a second contact 24 and a third contact 26. In one embodiment, the first contact 22 may be configured as a drain, the second contact 24 may be configured as a source and the third contact 26 may be configured as a gate. Furthermore, as illustrated in FIG. 4, a voltage snubber circuit 33 may be coupled in parallel with the MEMS switch 20 and configured to limit voltage overshoot during fast contact separation as will be explained in greater detail hereinafter. In certain embodiments, the snubber circuit 33 may include a snubber capacitor (not shown) coupled in series with a snubber resistor (not shown). The snubber capacitor may facilitate improvement in transient voltage sharing during the sequencing of the opening of the MEMS switch 20. Furthermore, the snubber resistor may suppress any pulse of current generated by the snubber capacitor during closing operation of the MEMS switch 20. In one example embodiment, snubber 33 may comprise one or more types of circuits, e.g., an R/C snubber and/or a solid-state snubber (such as a metal oxide varistor (MOV) or any suitable overvoltage protection circuit, e.g., a rectifier coupled to feed a capacitor. Preferably, the snubber capacitor should be constructed on each die to avoid inductance issues.

In accordance with further aspects of the present technique, a load circuit 40, such an electromotive machine or electric motor, may be coupled in series with the first MEMS switch 20. The load circuit 40 may be connected to a suitable voltage source $V_{BUS}$, such as an alternating voltage (AC) or a direct voltage (DC) 44. In addition, the load circuit 40 may comprise a load inductance 46 $L_{LOAD}$, where the load inductance $L_{LOAD}$ 46 is representative of a combined load inductance and a bus inductance viewed by the load circuit 40. The load circuit 40 may also include a load resistance $R_{LOAD}$ 48 representative of a combined load resistance viewed by the load circuit 40. Reference numeral 50 is representative of a load circuit current $L_{LOAD}$ that may flow through the load circuit 40 and the first MEMS switch 20.

In the illustrated embodiment, a balanced diode bridge 28 is depicted as having a first branch 29 and a second branch 31. As used herein, the term "balanced diode bridge" is used to represent a diode bridge that is configured such that voltage drops across both the first and second branches 29, 31 are substantially equal. The first branch 29 of the balanced diode bridge 28 may include a first diode D1 30 and a second diode D2 32 coupled together to form a first series circuit. In a similar fashion, the second branch 31 of the balanced diode bridge 28 may include a third diode D3 34 and a fourth diode D4 36 operatively coupled together to form a second series circuit. It will be appreciated that each of the diode elements in balanced diode bridge 28 may be made up of multiple diodes in parallel rather than just one individual diode. This type of multi-diode arrangement may facilitate resistance reduction in the branches of the diode bridge.

In one embodiment, the first MEMS switch 20 may be coupled in parallel across midpoints of the balanced diode bridge 28. The midpoints of the balanced diode bridge may include a first midpoint located between the first and second diodes 30, 32 and a second midpoint located between the third and fourth diodes 34, 36. Furthermore, the first MEMS switch 20 and the balanced diode bridge 28 may be tightly packaged to facilitate minimization of parasitic inductance caused by the balanced diode bridge 28 and in particular, the connections to the MEMS switch 20. It may be noted that, in accordance with exemplary aspects of the present technique, the first MEMS switch 20 and the balanced diode bridge 28 are positioned relative to one another such that the inherent inductance between the first MEMS switch 20 and the balanced diode bridge 28 produces a L*di/dt voltage, where L represents the parasitic inductance. The voltage produced may be less than a few percent of the voltage across the drain 22 and source 24 of the MEMS switch 20 when carrying a transfer of the load current to the diode bridge 28 during the MEMS switch 20 turn-off which will be described in greater detail hereinafter. In one embodiment, the first MEMS switch 20 may be integrated with the balanced diode bridge 28 in a single package 38 or optionally, the same die with the intention of minimizing the inductance interconnecting the MEMS switch 20 and the diode bridge 28. By way of example, FIG. 4 illustrates one MEMS switch coupled to the diode bridge. In general, multiple switches in parallel and/or series circuit may be coupled to the diode bridge.

Additionally, the over current protection circuitry 15 may include a pulse circuit 52 coupled in operative association with the balanced diode bridge 28. The pulse circuit 52 may be configured to detect a switch condition and initiate opening of the MEMS switch 20 responsive to the switch condition. As used herein, the term "switch condition" refers to a condition that triggers changing a present operating state of the MEMS switch 20. For example, the switch condition may result in changing a first closed state of the MEMS switch 20 to a second open state or a first open state of the MEMS switch 20 to a second closed state. A switch condition may occur in response to a number of actions including but not limited to a circuit fault, circuit overload, or switch ON/OFF request.

The pulse circuit 52 may include a pulse switch 54 and a pulse capacitor $C_{PULSE}$ 56 series coupled to the pulse switch 54. Further, the pulse circuit may also include a pulse inductance $L_{PULSE}$ 58 and a first diode $D_P$ 60 coupled in series with the pulse switch 54. The pulse inductance $L_{PULSE}$ 58, the diode $D_P$ 60, the pulse switch 54 and the pulse capacitor $C_{PULSE}$ 56 may be coupled in series to form a first branch of the pulse circuit 52, where the components of the first branch may be configured to facilitate pulse current shaping and timing. Also, reference numeral 62 is representative of a pulse circuit current $I_{PULSE}$ that may flow through the pulse circuit 52.

In accordance with aspects of the present invention, the MEMS switch 20 may be rapidly switched (e.g., on the order of microseconds) from a first closed state to a second open state while carrying no current or a near zero current. This may be achieved through the combined operation of the load circuit 40, and pulse circuit 52 including the balanced diode bridge 28 coupled in parallel across contacts of the MEMS switch 20.

Figure 6:
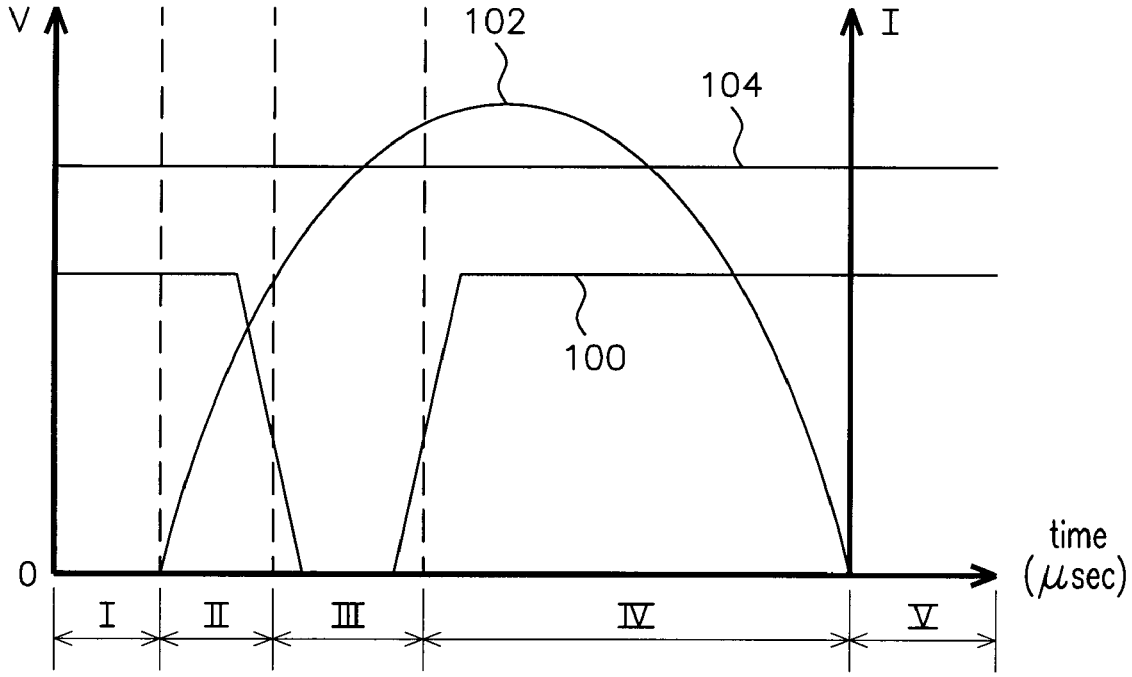
FIG. 6 illustrates plots of example waveforms as may develop in the exemplary MEMS based switching system of FIGS. 3 and 4 as a switch is being set to a temporary open condition to avoid contact stiction.

FIG. 6 illustrates plots of example waveforms as a function of time as may be generated as a switch is being set to the temporary open condition, in the event an over current protection circuit is utilized in a parallel circuit with the micro-electromechanical system switching circuitry. It is noted that the controller may be configured to selectively control, as the switching algorithm is executed, whether the over-current protection circuit is fired to momentarily form the electrically conductive path during any temporary open switching condition. For instance, there may be situations where such a firing may not be desirable due to voltage imbalances that may occur at the branches of the diode bridge.

It is reiterated that such over current protection circuit and corresponding pulsing technique is not a requirement for practicing aspects of the present invention since aspects of the present invention may be practiced without any such pulsing technique, or without utilization of any zero-crossing technique. Moreover, the controller may be configured to selectively control, as the switching algorithm is executed, whether the over-current protection circuit is set to momentarily form the electrically conductive path during any temporary open switching condition. Alternatively, aspects of the present invention may be practiced in combination with techniques that may (but need not) utilize both the zero-crossing and the pulsing technique.

In FIG. 6, waveform 100 represents a gating (e.g., actuating) signal applied at the gate of a switch being set to the temporary open condition. Waveform 102 represents a pulse current from the pulse circuit. Waveform 104 represents steady state load current. Time intervals I and V represent normal system operation. That is, the switch is closed and circuit load current may be at steady state. Time interval II represents initiation of a temporary switch opening and pulse firing. Time interval III represents the temporary switch opening. Time interval IV represents a return to the generally closed condition. It should be observed from the foregoing waveforms that each event associated with temporary switch opening occurs while the pulse current exists. That is, while the over-current protection circuit enables momentary formation of an electrically conductive path in parallel with the MEMS switching circuitry.

Figure 7:
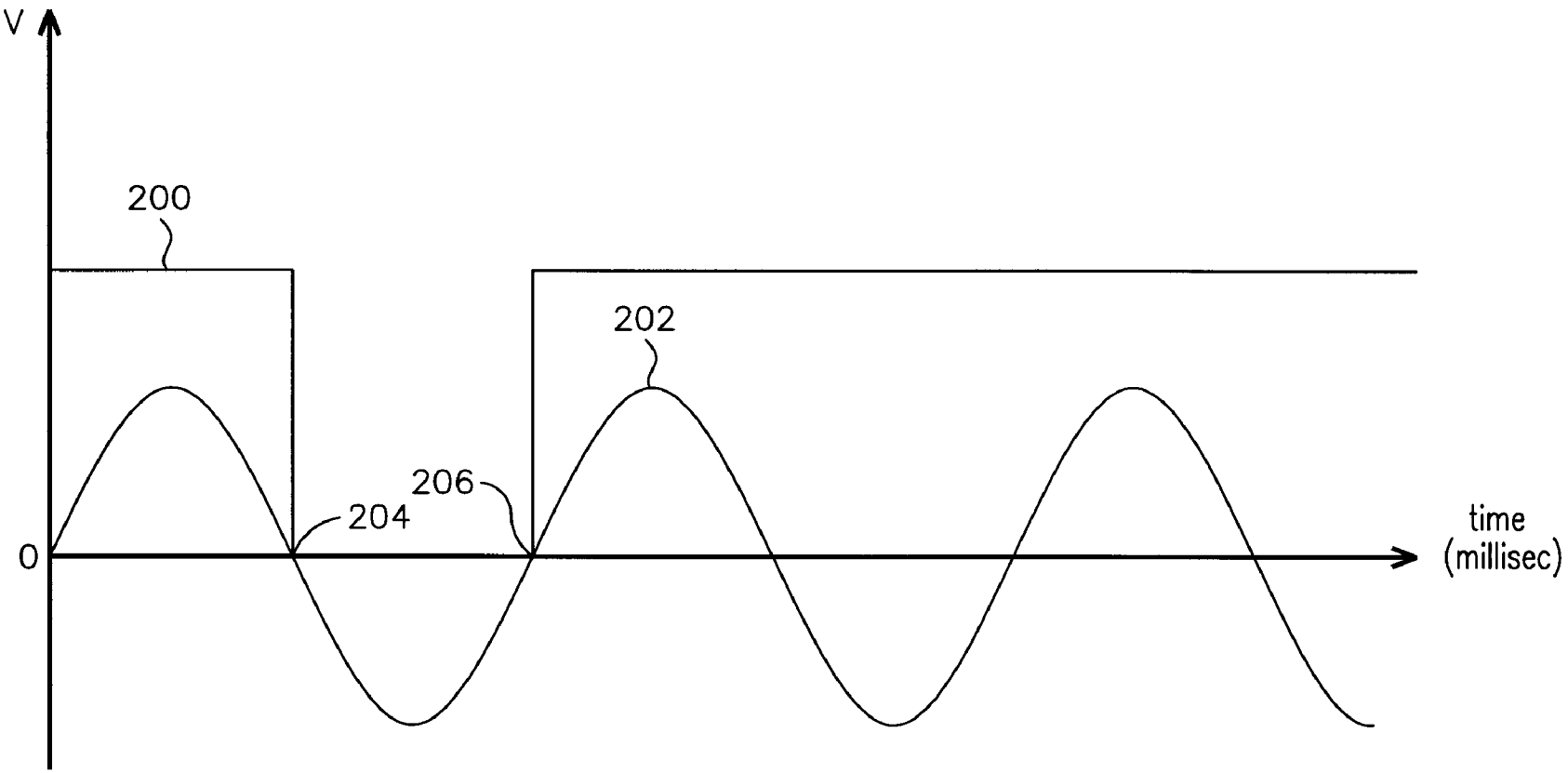
FIG. 7 illustrates plots of example waveforms as may develop in the event zero-crossing detection circuitry is utilized with the micro-electromechanical system switching circuitry.

FIG. 7 illustrates plots of example waveforms as a function of time as may be generated as a switch is being set to the temporary open condition, in the event zero-crossing detection circuitry is utilized with the micro-electromechanical system switching circuitry. In FIG. 7, waveform 200 represents a gating (e.g., actuating) signal applied at the gate of a switch being set to the temporary open condition. Waveform 202 represents a voltage across the MEMS switching circuitry including zero-crossings. Note that turn-off transition 204 in synchronicity with a first zero-crossing represents initiation of the temporary switch opening. Note that turn-on transition 206 in synchronicity with a second zero-crossing represents a return to the generally closed condition.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system comprising:

micro-electromechanical system switching circuitry comprising a plurality of micro-electromechanical switches, wherein said plurality of micro-electromechanical switches generally operates in a closed switching condition during system operation; and a controller coupled to the electromechanical switching circuitry, the controller configured to actuate at least one of said micro-electromechanical switches to a temporary open switching condition while a remainder of micro-electromechanical switches remains in the closed switching condition to conduct a load circuit current and avoid interrupting system operation, said temporary open switching condition of the switch useful to avoid a tendency of switch contacts to stick to one another.

2. The system of claim 1 wherein the controller is further configured to perform a switching algorithm configured to actuate at least one distinct micro-electromechanical switch of said plurality of micro-electromechanical switches to the temporary open switching condition, wherein said at least one distinct switch comprises a switch not previously having been actuated over a predefined period of time to the temporary open switching condition, and, while actuation of said at least one distinct micro-electromechanical switch to the temporary open switching condition occurs, another remainder of the micro-electromechanical switches remains in the closed switching condition to avoid interrupting system operation.

3. The system of claim 2 wherein the controller is further configured to selectively execute the switching algorithm over said predefined period of time so that eventually each of said plurality of switches is actuated at least once to the temporary open switching condition over the period of time, thereby ensuring each switch of the micro-electromechanical system switching circuitry has been actuated to avoid the tendency of respective switch contacts to stick to one another.

4. The system of claim 1 further comprising circuitry coupled to the micro-electromechanical system switching circuitry to avoid current flow through the contacts of said at least one of said micro-electromechanical switches as the switch transitions to enter the temporary open switching condition from the closed switching condition.

5. The system of claim 4 further wherein said circuitry is further configured to collapse a voltage level across the contacts of said at least one of said micro-electromechanical switches as the switch returns out of the temporary open switching condition to the closed switching condition.

6. The system of claim 1 further comprising circuitry configured to synchronize the occurrence of the temporary open switching condition of said at least one of said micro-electromechanical switches with the occurrence of a zero crossing of at least one of the following: an alternating source voltage and an alternating load circuit current.

7. A system comprising:

micro-electromechanical system switching circuitry comprising at least one micro-electromechanical switch, wherein said at least one micro-electromechanical switch generally operates in a closed switching condition during system operation;

a controller coupled to the electromechanical switching circuitry, the controller configured to actuate said at least one micro-electromechanical switch to a temporary open switching condition; and an over-current protection circuitry connected in a parallel circuit with the micro-electromechanical system switching circuitry, the over-current protection circuitry configured to momentarily form an electrically conductive path during said temporary open switching condition, said electrically conductive path in a parallel circuit with the micro-electromechanical system switching circuitry and adapted to avoid current flow through contacts of the switch as the switch transitions to enter the temporary open switching condition from the closed switching condition, and to collapse a voltage level across the contacts of the switch as the switch returns out of the temporary open switching condition to the closed switching condition.

8. The system of claim 7 wherein further comprising a plurality of micro-electromechanical switches in combination with said at least one micro-electromechanical switch, wherein said plurality of micro-electromechanical switches generally also operates in a closed switching condition during system operation.

9. The system of claim 8 wherein the controller is further configured to perform a switching algorithm configured to actuate at least one micro-electromechanical switch of said plurality of micro-electromechanical switches to the temporary open switching condition, wherein said at least one switch comprises a switch not previously having been actuated over a predefined period of time to the temporary open switching condition, and, while actuation of said at least one micro-electromechanical switch occurs, a remainder of micro-electromechanical switches remains in the closed switching condition to avoid interrupting system operation.

10. The system of claim 9 wherein the controller is further configured to selectively execute the switching algorithm over said predefined period of time so that eventually each of said plurality of switches is actuated at least once to the temporary open switching condition over the period of time, thereby ensuring each switch of the micro-electromechanical system switching circuitry has been actuated to avoid the tendency of respective switch contacts to stick to one another.

11. The system of claim 9 wherein the over-current protection circuitry is configured to momentarily form an electrically conductive path during the temporary open switching condition of said at least one micro-electromechanical switch of said plurality of micro-electromechanical switches, said electrically conductive path in a parallel circuit with the micro-electromechanical system switching circuitry and adapted to avoid current flow through contacts of said at least one switch as said at least one switch transitions to enter the temporary open switching condition from the closed switching condition, and to collapse a voltage level across the contacts of the switch as the switch returns out of the temporary open switching condition to the closed switching condition.

12. The system of claim 10 wherein the controller is further coupled to the over-current protection circuitry and is configured to selectively control as the switching algorithm is executed whether the over-current protection circuit is set to momentarily form the electrically conductive path during any temporary open switching condition.

13. The system of claim 8 further comprising circuitry configured to synchronize the occurrence of the temporary open switching condition of said at least one of the plurality of micro-electromechanical switches with the occurrence of a zero crossing of at least one of the following: an alternating source voltage and an alternating load circuit current.

14. A method for actuating micro-electromechanical system switching circuitry to avoid a tendency of switch contacts to stick to one another, said micro-electromechanical system switching circuitry comprising a plurality of micro-electromechanical switches, wherein said plurality of micro-electromechanical switches generally operates in a closed switching condition during system operation, the method comprising:

actuating at least one of said micro-electromechanical switches to a temporary open switching condition while a remainder of micro-electromechanical switches remains in the closed switching condition to conduct a load circuit current and avoid interrupting system operation, said temporary open switching condition of the switch useful to avoid a tendency of switch contacts to stick to one another.

15. The method of claim 14 further comprising actuating at least one distinct micro-electromechanical switch of said plurality of micro-electromechanical switches to the temporary open switching condition.

16. The method of claim 15 wherein the actuating of said at least one distinct switch comprises actuating a switch not previously having been actuated over a predefined period of time to the temporary open switching condition.

17. The method of claim 16, while the actuating of said at least one distinct micro-electromechanical switch to the temporary open switching condition occurs, letting another remainder of the micro-electromechanical switches to remain in the closed switching condition to avoid interrupting system operation.

18. The method of claim 16 further comprising performing a switching algorithm over said predefined period of time so that eventually each of said plurality of switches is actuated at least once to the temporary open switching condition over the period of time, thereby ensuring each switch of the micro-electromechanical system switching circuitry has been actuated to avoid the tendency of respective switch contacts to stick to one another.

19. The method of claim 14 further comprising momentarily forming an electrically conductive path during said temporary open switching condition, said electrically conductive path in a parallel circuit with the micro-electromechanical system switching circuitry to avoid a current flow through the contacts of said at least one of said plurality of micro-electromechanical switches as the switch transitions to enter the temporary open switching condition from the closed switching condition.

20. The method of claim 19 further comprising collapsing a voltage level across the contacts of said at least one of said plurality of micro-electromechanical switches as the switch returns out of the temporary open switching condition to the closed switching condition.

21. The method of claim 14 further comprising synchronizing the occurrence of the temporary open switching condition of said at least one of said plurality of micro-electromechanical switches with the occurrence of a zero crossing of at least one of the following: an alternating source voltage and an alternating load circuit current.

* * * * *